US008683768B2

(12) United States Patent
Gerkes et al.

(10) Patent No.: US 8,683,768 B2
(45) Date of Patent: Apr. 1, 2014

(54) CEILING PANEL CLIP

(75) Inventors: Martin Daniel Gerkes, Toronto (CA); Heikki Kolga, Maple (CA); Ronald White, Holland Landing (CA)

(73) Assignee: CertainTeed Canada, Inc., Toronto, ON (CA)

( * ) Notice: Subject to any disclaimer, the term of this patent is extended or adjusted under 35 U.S.C. 154(b) by 114 days.

(21) Appl. No.: 13/067,237

(22) Filed: May 18, 2011

(65) Prior Publication Data

US 2012/0023853 A1 Feb. 2, 2012

(30) Foreign Application Priority Data

Jul. 27, 2010 (CA) ..... 2711332

(51) Int. Cl.
*E04B 9/00* (2006.01)
*E04C 2/38* (2006.01)

(52) U.S. Cl.
USPC ..... 52/506.08; 52/712; 52/489.1

(58) Field of Classification Search
CPC ..... E04B 9/0428; E04B 9/0435; E04B 9/205; E04B 9/242
USPC ..... 52/506.06–506.09, 489.1, 489.2, 712, 52/713
See application file for complete search history.

(56) References Cited

U.S. PATENT DOCUMENTS

| | | | | | |
|---|---|---|---|---|---|
| 2,141,700 | A * | 12/1938 | Tinnerman | ..... | 52/511 |
| 4,408,428 | A * | 10/1983 | Brooke et al. | ..... | 52/506.07 |
| 4,438,613 | A * | 3/1984 | Hintsa et al. | ..... | 52/506.09 |
| 4,548,010 | A | 10/1985 | Hintsa | | |
| 5,428,930 | A | 7/1995 | Bagley et al. | | |
| 5,535,566 | A | 7/1996 | Wilson et al. | | |
| 5,725,302 | A * | 3/1998 | Sirkin | ..... | 362/365 |
| 6,971,210 | B2 * | 12/2005 | Kliegle et al. | ..... | 52/506.07 |
| 7,014,493 | B1 * | 3/2006 | Battard | ..... | 439/373 |
| 7,076,928 | B2 * | 7/2006 | Kliegle et al. | ..... | 52/506.09 |
| 8,079,192 | B2 * | 12/2011 | Gerkes et al. | ..... | 52/506.08 |
| 2005/0034402 | A1 * | 2/2005 | Johnson | ..... | 52/506.08 |
| 2007/0193131 | A1 * | 8/2007 | Ortiz | ..... | 52/144 |

* cited by examiner

*Primary Examiner* — Elizabeth A Plummer

(57) ABSTRACT

A ceiling panel clip with improved characteristics includes a torsion spring retaining loop that has a free end captured beneath a frame member of the ceiling panel. The retaining loop at one end thereof is integral with a base portion of the clip and the free end extends downwardly to the base portion. The base portion and retaining loop preferably cooperate to capture a coiled portion of a torsion spring used to suspend the ceiling panel. Preferably, securing legs of the torsion spring are biased inwardly to allow the coiled portion to be inserted on the retaining loop. Release of the securing legs captures the coiled portion on the clip.

20 Claims, 5 Drawing Sheets

CEILING PANEL CLIP

FIELD OF THE INVENTION

The present invention relates to a clip for use in association with a ceiling panel for suspending of the panel below a support structure. The invention also relates to a ceiling panel in combination with a clip.

BACKGROUND OF THE INVENTION

There are a number of well known arrangements for securing ceiling panels to form a finished ceiling surface. Such systems include the conventional "T"-bar systems where ceiling panels are placed above the "T"-bar and supported by outwardly extending flanges of the "T"-bar grid system. It is also known to suspend ceiling panels beneath a support structure such that the panels themselves form the ceiling surface. These suspension ceiling panel systems can include torsion spring arrangements for releasably suspending the ceiling panels beneath a support grid. Examples of suspended ceiling panel systems that include torsion springs for securing thereof are shown in our U.S. Pat. Nos. 5,535,566, 5,428,930 and 4,548,010.

Suspended ceiling panels preferably include a perimeter frame secured about the periphery of an acoustical body member. Finished surfaces are normally applied to the lower surface of the acoustical body member and can extend along the side surfaces of the perimeter frame.

An earlier suspended ceiling panel system has a push-on clip for securing of a torsion spring adjacent a top surface of a ceiling panel. These push-on clips include an open hook extending above a base portion of the clip with a gap above the base portion to allow a torsion spring to be inserted and retained on the hook. The hook is secured at one end thereof to the base portion and the opposite end is free of contact with and spaced above the base portion. With this open hook design, the torsion spring can be secured to the clip prior to or after securement of the clip to the panel. The base portion of this clip tightly engages an inwardly extending flange of a perimeter frame of the panel. Various retention-type locks or projections can be provided on the base portion for engagement with the flange of the perimeter frame.

The present invention provides a clip for a ceiling panel with improved characteristics with respect to retention of a torsion spring or other securing structure on the clip.

SUMMARY OF THE INVENTION

A ceiling panel according to the present invention includes an acoustical body member having a peripheral frame secured about the body member. The peripheral frame includes an inwardly extending top flange partially overlying a top surface of the body member. A series of torsion spring retaining clips engage the ceiling panel with each clip retaining a coil of a torsion spring having two elongate securing arms. Each torsion spring retaining clip includes a base portion overlying the top flange with a securing tab connected to an edge of the base portion underlying the top flange. The base portion and the securing tab engage the top flange either side thereof to secure the clip to the top flange. Each torsion spring retaining clip includes an integral retaining finger connected to and extending upwardly from the base portion and passing through the coil of the torsion spring. The retaining finger has a free end with a hooked portion underlying and in load transfer relationship with the top flange capturing the torsion spring on the ceiling panel.

In a preferred aspect of the invention, the hooked portion of the retaining finger is planar and extends inwardly at the level of the securing tab.

In a preferred aspect of the invention the ceiling panel includes four clips and torsion springs with each clip and torsion spring being located adjacent a corner of a rectangular ceiling panel.

In a further aspect of the invention each hooked portion extends inwardly into a cutaway portion of the securing tab.

According to an aspect of the invention, the base portion of the retaining clip includes a cutaway portion aligned with the cutaway portion of the securing tab.

In a different aspect of the invention, the retaining finger is of an inverted U shape centered on and extending above the base portion.

In a further preferred aspect of the invention, the cutaway portions in the base portion and the securing tab have a curvature of a size to allow the coil portion of the torsion spring to be inserted on the retaining finger by passing through the cutaway portions with the hooked portion passing through the coil portion. Preferably, the two elongate securing arms of each coil spring are movable towards each other reducing an angle defined between the securing arms to allow the coil portion to be inserted on the retaining finger.

In a further aspect of the invention, the securing arms of each torsion spring are movable from a neutral position inwardly towards each other against a bias force created by the torsion spring, the securing arms in the neutral position locking the torsion spring on the retaining finger by an interference relationship with the base portion.

The invention is also directed to a ceiling panel securing clip. The securing clip includes a base portion overlying a securing tab connected to an edge of the base portion to collectively define a shallow U shape with a securing gap therebetween. An integral retaining finger extends upwardly from a position on a side of the base portion in opposed relationship with the edge of the base portion connected to the securing tab, the retaining finger extending across the base portion at a raised position and then extending downwardly towards the base portion with a free end of the retaining finger having a hooked portion extending inwardly into a cutaway portion of the securing tab. The hooked portion is generally in the plane of the shallow U shape.

In a preferred aspect of the invention, the securing tab includes a cutaway portion aligned with the cutaway portion of the base portion.

In a further aspect of the invention, the cutaway portion in the base portion is semi circular.

In a different aspect of the invention, the securing tab is divided into two securing tabs spaced either side of the cutaway portion of the base portion.

In a further aspect of the invention, the hooked portion extends less than halfway into the cutaway portion.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
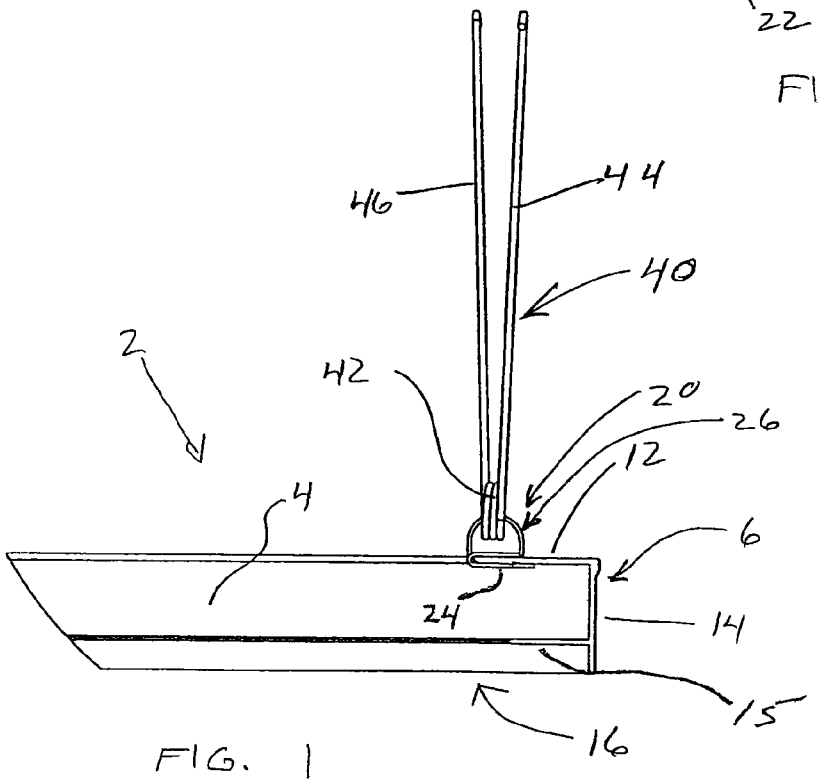
FIG. 1 is a partial cross-sectional view of the ceiling panel with the clip and torsion spring mounted to a top flange of the ceiling panel.

The ceiling panel 2 shown in FIG. 1 includes a body of acoustical dampening material 4 having a perimeter frame 6 secured about the edges of the ceiling panel 2. The perimeter frame is defined by a series of frame members 8 and in the example shown the frame members include mitered corners 10. Each frame member 8 includes a top flange 12, a side flange 14 and an intermediate flange 15. The ceiling panel includes a bottom surface 16 which is the visible surface of the ceiling panel. This surface can have various substrates attached thereto to effectively define the finished surface of the ceiling panel. Such additional substrates have not been shown.

In a suspended ceiling panel system it is preferred to provide securement adjacent the corners of the panels. This assists in alignment of the panels and also assists in drawing the panel up to abutt against a supporting structure. In this way the level of the ceiling panels beneath a support structure is more consistent.

The ceiling panel 2 includes a push-on securing clip 20 that receives and retains the torsion spring 40. Typically a rectangular ceiling panel will include four push-on securing clips with each securing clip having an associated torsion spring and being positioned adjacent a corner of the panel. Each securing clip includes a mounting structure 21 defined by the combination of the base portion 22 and the securing tabs 24. Each securing tab 24 is integrally connected to the base portion 22 along one side thereof with the securing tab extending beneath the base portion 22. The base portion and the securing tab define a "U"-shaped mounting structure that receives the top flange 12 of a frame member 8 and provides a secure attachment of the clip to the frame member.

The securing clip includes a torsion spring retaining loop 26 that receives and retains the coiled portion 42 of the torsion spring 40. The retaining loop 26 also includes a hook member 36 at a free end thereof that engages the underside of the top flange 12 of a frame member 8. In this way, the retaining loop 26 is supported by the base portion 42 and the loop is also in direct engagement with the lower surface of the top flange 12.

Figure 3:
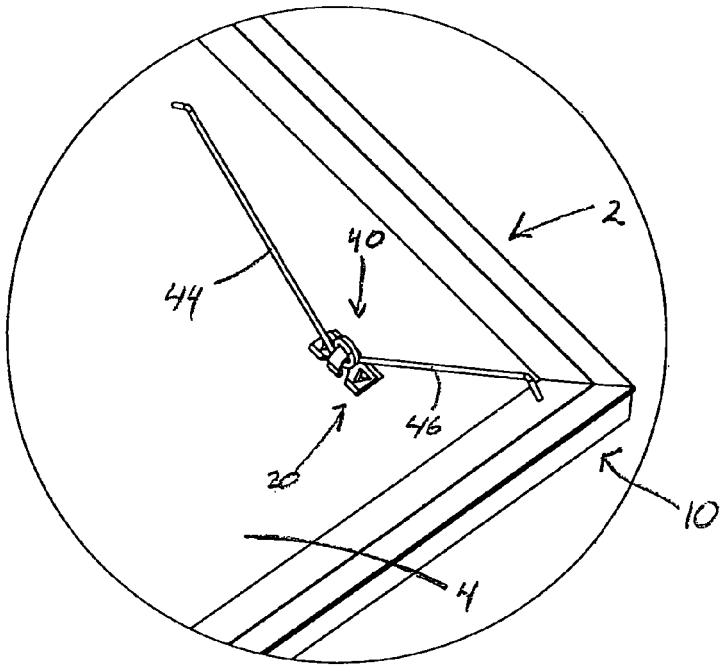
FIG. 3 shows a securing clip about to be applied to the top flange of the ceiling panel adjacent a corner of the ceiling panel.
Figure 4:
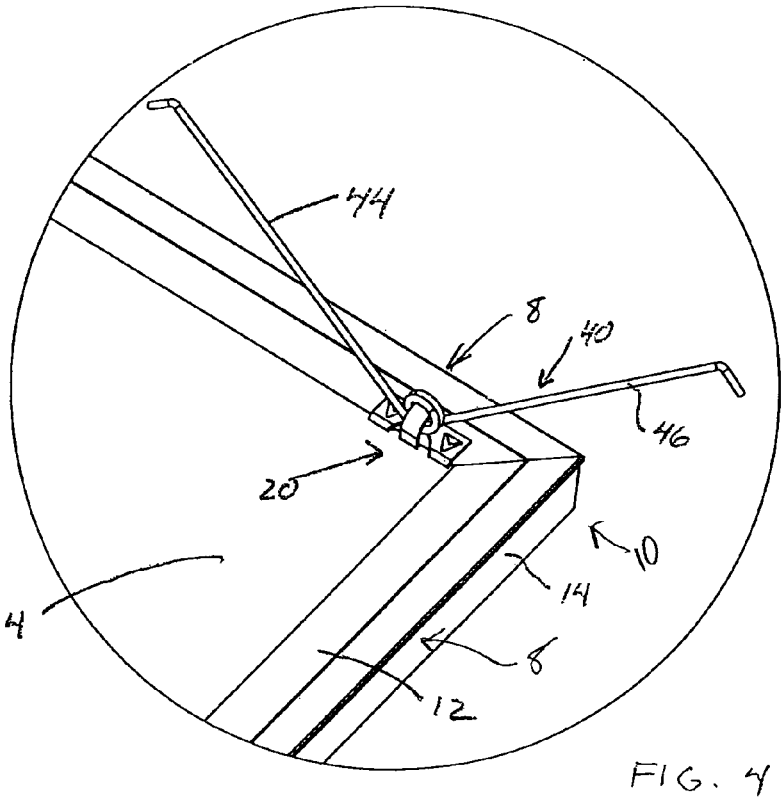
FIG. 4 shows a torsion spring and securing clip in engagement with a top flange of a perimeter frame adjacent a corner of the ceiling panel.

FIGS. 3 and 4 illustrate the insertion of the securing clip 20 at a corner of the ceiling panel 2 and the engagement of the hook member 36 beneath the top flange 12. Since the hook member 36 of the clip 20 is in direct engagement with the top flange 12, the vertical load exerted by the torsion spring, which is supporting the ceiling panel, on the retaining loop 26, is shared by the hook member 36, the top flange 12 and the base portion 22 of the clip 20. Other positions of the clips on the ceiling panels can be used.

Figure 5:
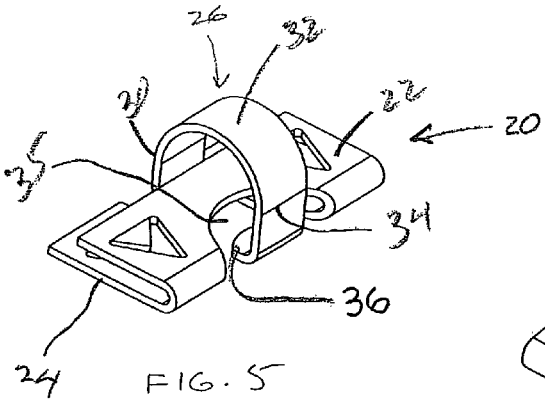
FIG. 5 is a perspective view of the securing clip.
Figure 6:
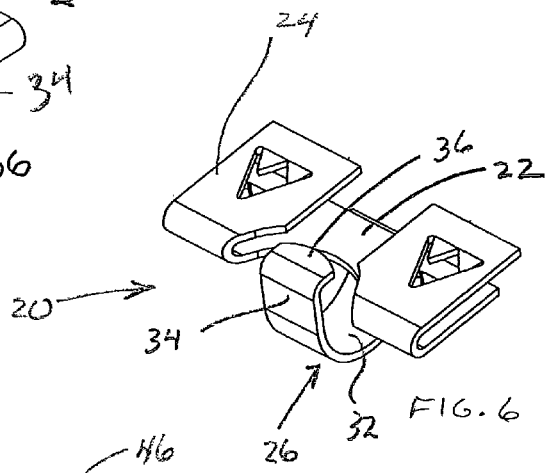
FIG. 6 is a bottom perspective view of the securing clip.

FIGS. 5 and 6 show the preferred structure of the securing clip 20. The mounting structure 21 includes the base portion 22 that will overlay the top flange 12 of the ceiling panel. The mounting structure also includes the pair of securing tabs 24 which are positioned on opposite sides of the retaining loop 26. The retaining loop 26 includes a first upwardly extending arm 30 connected to the base portion 22, a curved second arm 32 which passes over the base portion 22, a downwardly extending arm 34 which extends to the level of the base portion 22 and an inwardly extending hook member 36 for passing beneath the top flange 12 of a frame member 8 of the ceiling panel. The hook member 36 extends inwardly much in the manner of the securing tabs 24. Any load placed on the retaining loop 26 by a torsion spring is distributed over the securing clip and it is difficult to cause inadvertent release of the retaining loop from the top flange. The securement of both ends of the retaining loop 26 to the top flange improves the load carrying capacity of the clip. As shown, the hook member 36 is at the level of the securing tabs and of a similar thickness and integral with the clip. Preferably the clip is formed by stamping and bending.

Figure 7:
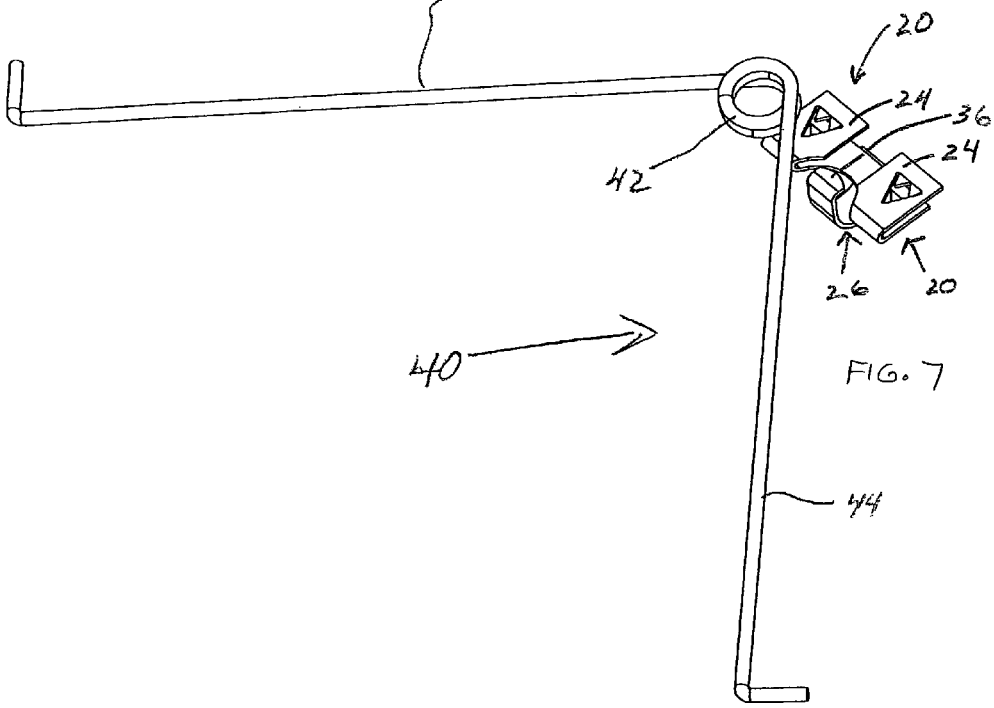
FIG. 7 is a bottom perspective view showing a torsion spring about to be secured to the securing clip.

Also shown in FIG. 5 is the recessed portion generally shown as 35 which, in combination with the retaining loop 26, allows a torsion spring to be inserted on the securing clip. As shown in FIG. 7, the torsion spring 40 is generally horizontal and the securing clip 20 has the securing tabs generally in a horizontal orientation.

Figure 8:
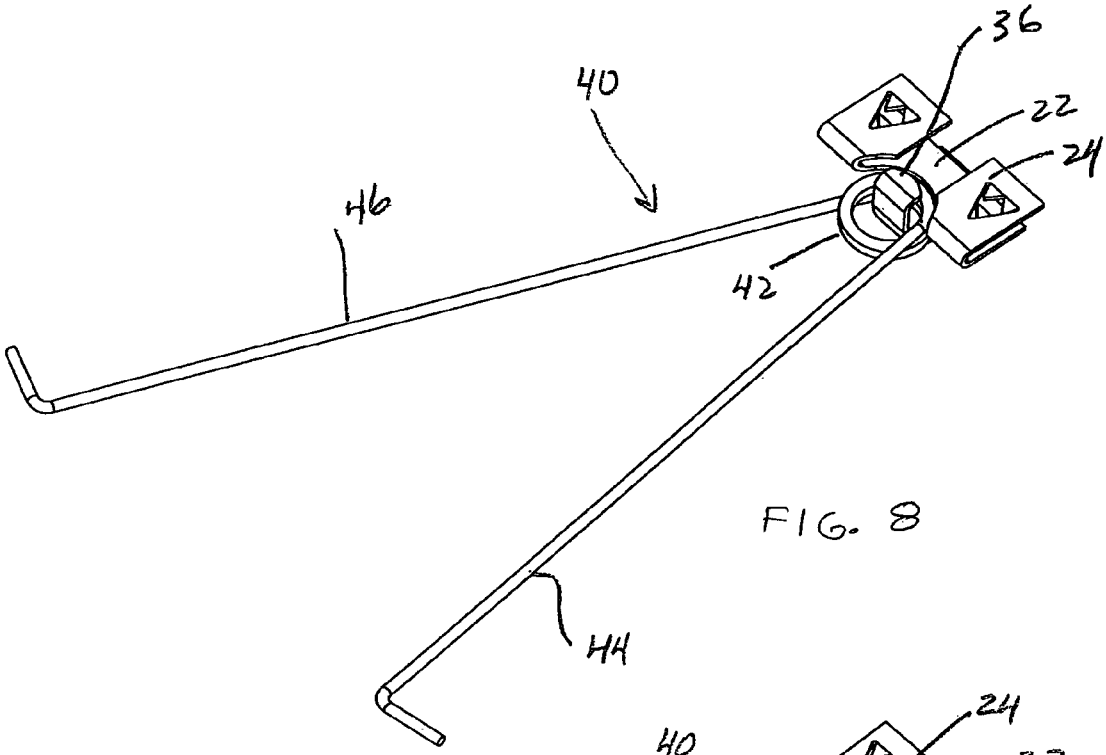
FIG. 8 shows a torsion spring being partially deformed by inner movement of the securing arms allowing the torsion spring to pass through a receiving port and engage a retaining loop of the securing clip.
Figure 9:
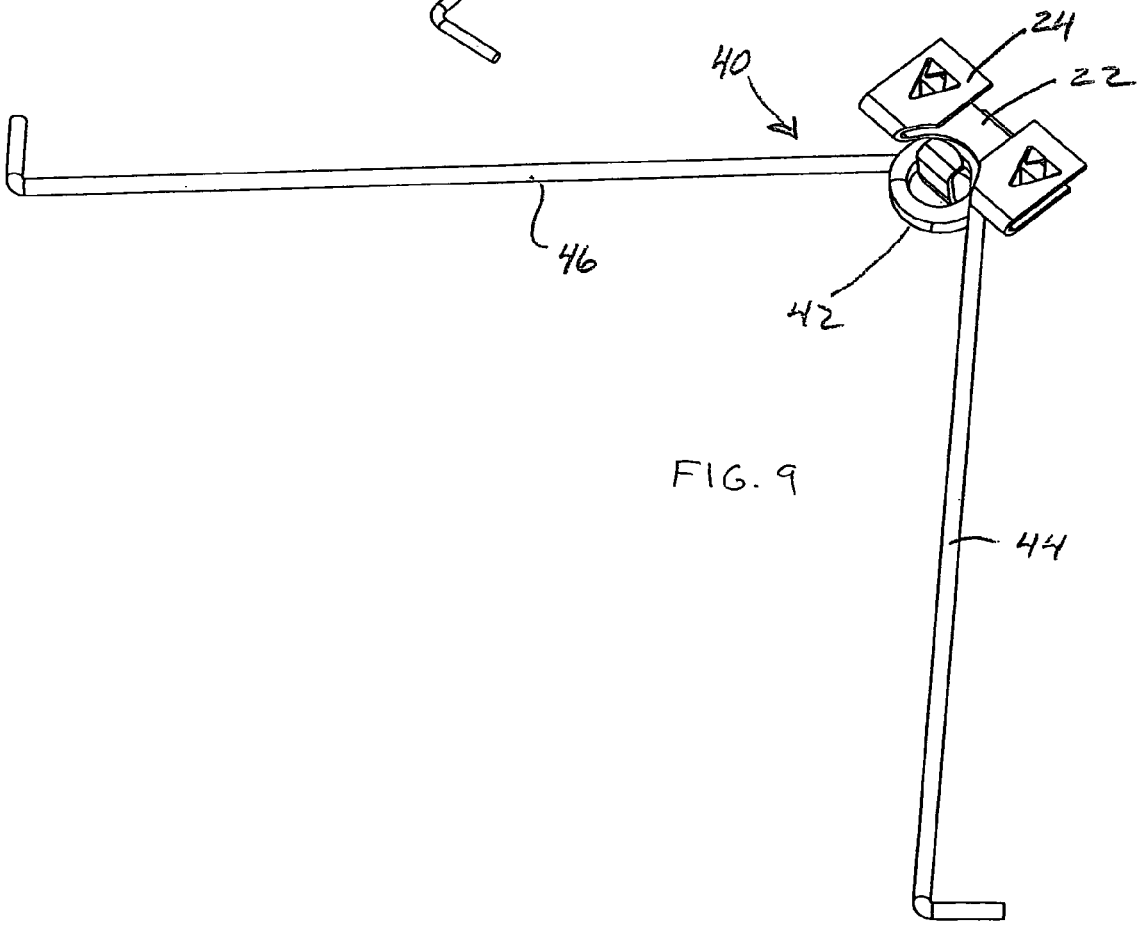
FIG. 9 is a view similar to FIG. 8 with the torsion spring arms in a release position.
Figure 10:
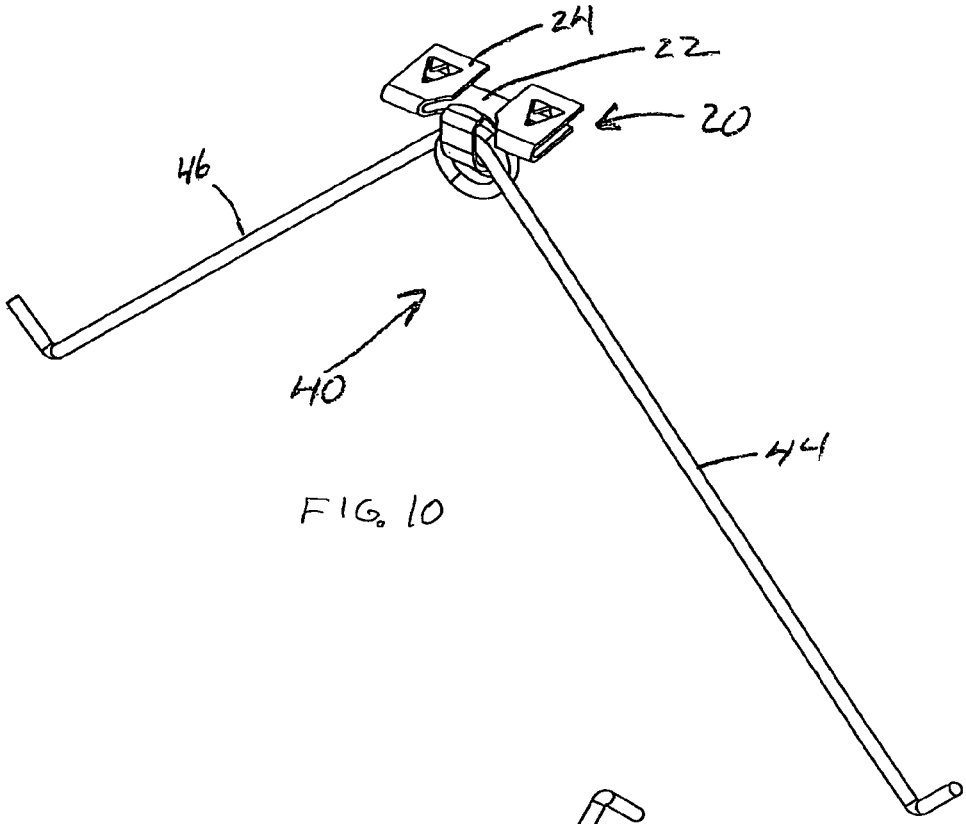
FIG. 10 is a bottom perspective view of the torsion spring mounted on the securing clip.
Figure 11:
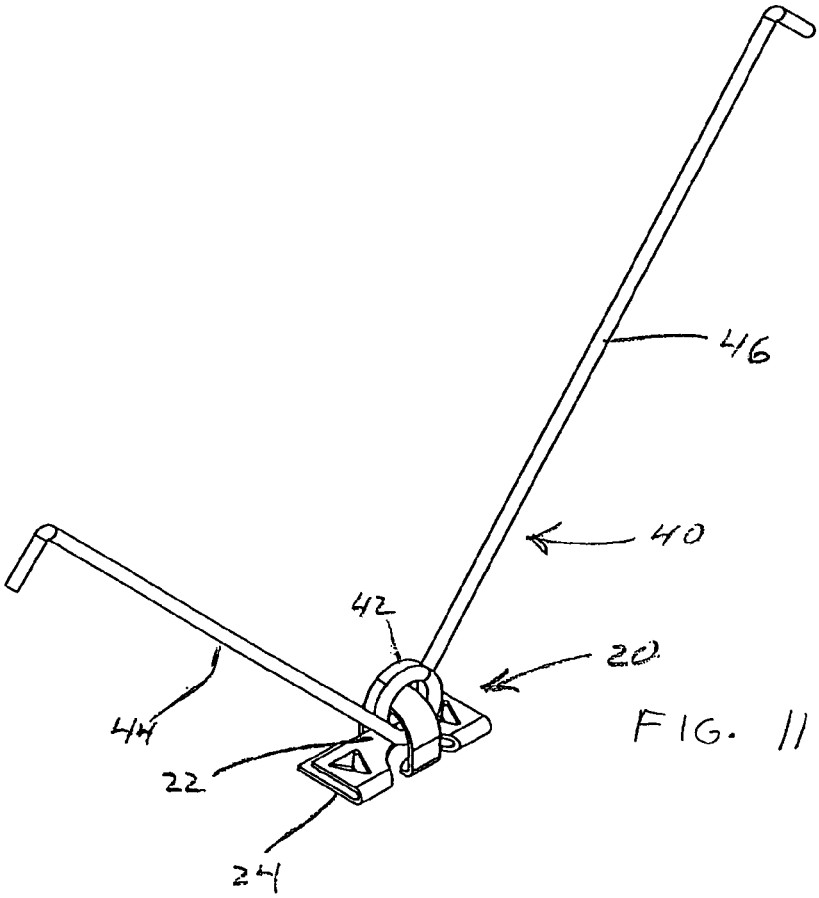
FIG. 11 is a top perspective view of the torsion spring mounted and retained on the securing clip.

With this arrangement, there is a curved securement gap associated with the base portion 22 and the inwardly extending hook portion 36 that will receive the coiled portion 42 of the torsion spring 40. This aspect is shown in FIG. 8. The arms 44 and 46 of the torsion spring 40 have been distorted inwardly from a neutral position and are thus within the general circumference of the coil portion 42 adjacent the retaining hook. This allows the coil portion 42 to pass through the gap and be positioned below the inwardly extending hook portion 36 and below the base portion. Once the spring arms are released, the torsion spring is effectively captured on the securing clip. The torsion spring is then free to rotate to an orientation generally 90° to the base portion as shown in FIGS. 10 and 11. This is the orientation of the torsion spring when suspending a panel.

Figure 2:
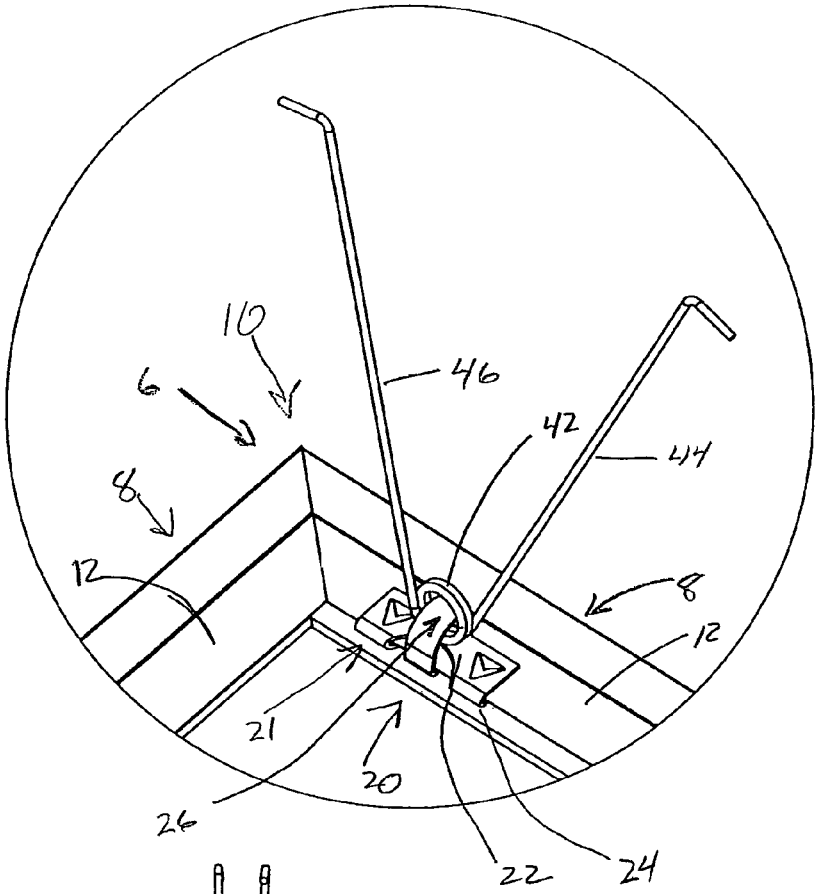
FIG. 2 is a partial perspective view of a securement clip engaging a top flange of a perimeter frame where the acoustical body member of the panel has been removed for illustration purposes.

The torsion spring is captured on the securing clip above the base portion (as shown in FIGS. 1 and 2) and inadvertently released thereof is unlikely. As shown in FIG. 2, once the retaining clip has been exerted on the frame member, the inwardly extending hook member 36 is positioned underneath the top flange 12 of the frame member 8 and the retaining loop is in secure engagement both with the top flange as well as the base portion 22 of the securing clip.

The base portion 22 of the securing clip includes downwardly extending locking members 52 that engage the top surface of the top flange 12. The securing tabs 24 also include locking members 54 which extend upwardly and will engage the bottom surface of the top flange 12. Preferably the top flange includes a camming member (slight rib), and these locking members are retained behind this camming member. Thus the securing clip has the mounting portion partially deformed to pass over these members and it is then allowed to spring inwardly to lock with the top flange. This structure makes it very difficult to remove the securing clip from the top flange by pulling it away from the edge of the top flange.

The retention of a torsion spring on a retaining clip as described simplifies final installation as the torsion springs can be preassembled on the retaining clips. Shipment of panels without the retaining clips and torsion springs secured is preferred. The final assembly is fast and also allows retaining clips to be located on panels at different positions on the panel to address any specific installation issues.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A ceiling panel securing clip for a suspended ceiling comprising a base portion overlying a securing tab connected to an inside edge of said base portion to define a U shape with a securing gap therebetween, said base portion including an outside edge opposite said inside edge with an integral retaining finger connected to and extending upwardly from said outside edge;

said retaining finger extending across said base portion at an elevated position and then extending downwardly to said securing tab at said inside edge, said retaining finger at a free end thereof having a hooked portion extending inwardly into a cutaway portion of both said base portion and said securing tab, said hooked portion being generally in a plane immediately below said securing gap.

2. A ceiling panel securing clip as claimed in claim 1, wherein said hooked portion is shaped and positioned relative to said cutaway portion to define a curved gap allowing a portion of a coil of a torsion spring to pass therethrough and be retained on said retaining finger.

3. A ceiling panel securing clip as claimed in claim 2, wherein said cutaway portion is semi circular and said hooked portion has a curved edge facing said cutaway portion.

4. A ceiling panel securing clip as claimed in claim 3, wherein said securing tab is divided into two securing tabs spaced on each side of said cutaway portion.

5. A ceiling panel securing clip as claimed in claim 4, wherein said hooked portion extends less than halfway into said cutaway portion of said base portion.

6. A ceiling panel securing clip as claimed in claim 4, wherein said hooked portion is coplanar with said securing tabs.

7. A ceiling panel securing clip as claimed in claim 1, in combination with a torsion spring having two spring arms interconnected by a coil portion;

said retaining finger passing through said coil portion and securing said torsion spring to said securing clip;

said torsion spring in a normal neutral position of said spring arms maintaining said coil portion captured on said retaining finger due to interaction with said base portion and the position of said hooked portion in said cutaway portion.

8. A ceiling panel securing clip in combination with a torsion spring as claimed in claim 7, wherein said spring arms when forced towards one another allow said coil portion to pass through said cutaway portion inwardly of said hooked portion whereby said torsion spring can be released from or inserted on said retaining finger.

9. A ceiling panel securing clip in combination with a torsion spring as claimed in claim 8, wherein said coil portion is circular and said cutaway portion is curved and of a shape greater than a semi circular area of said coil portion.

10. A ceiling panel securing clip in combination with a torsion spring as claimed in claim 9, wherein said coil portion is of a diameter of less than one inch and each spring arm is of a length of at least 3 inches, said spring arms in said normal neutral position defining an angle therebetween of at least 50° .

11. A ceiling panel comprising an acoustical body member and a peripheral frame about said body member;

said peripheral frame including an inwardly extending top flange partially overlying a top surface of said body member, a series of retaining clips with each retaining clip retaining a coil of a torsion spring having two elongate securing arms, each retaining clip including a base portion overlying a securing tab connected to an inside edge of said base portion to define a U shape with a securing gap therebetween;

said base portion overlying said top flange and said securing tab engaging a bottom surface of said top flange with said top flange located in said securing gap;

each retaining clip including an integral retaining finger extending upwardly from an outside edge of said base portion and across said base portion with a free end of said retaining finger extending downwardly past said base portion and said top flange;

said retaining finger passing through said coil of said torsion spring;

said retaining finger at said free end thereof including a hooked portion underlying said top flange forming a load transfer relationship with said top flange with said retaining finger capturing said torsion spring on said ceiling panel, and wherein said securing tab is inwardly recessed adjacent said hooked portion to define a cavity opposite said hooked portion and said hooked portion is in direct contact with said top flange.

12. A ceiling panel as claimed in claim 11 wherein said base portion includes at least one locking projection projecting into said securing gap at an angle to oppose removal of one of said deries of retaining clips from said top flange and said securing tab includes at least one locking projection projecting into said securing gap at an angle to oppose removal of one of said deries of retaining clips from said top flange.

13. A ceiling panel as claimed in claim 12 wherein said at least one locking projection of said base portion includes two locking projections located on opposite sides of said retaining finger.

14. A ceiling panel as claimed in claim 13 wherein said at least one locking projection of said securing tab is two locking projections, said retaining finger is centered on and extends across said base portion, said base portion being inwardly recessed to define a slot between said hooked portion and said base portion allowing a coil of the torsion to pass therethrough and engage said retaining finger.

15. A ceiling panel as claimed in claim 11 wherein said base portion and said securing tab each include at least two locking projections projecting at an angle into a gap between said base portion and said securing tab with said projections opposing removal of one of said deries retaining clips from said top flange.

16. A ceiling panel as claimed in claim 11, wherein said ceiling panel is rectangular and said series of retaining clips includes two retaining dips positioned on a first side of said ceiling panel and two retaining clips positioned on an opposite side of said ceiling panel.

17. A ceiling panel as claimed in claim 16, wherein said base portion includes a curved recess at said inside edge of a size to allow said coil of said torsion spring to be inserted on said retaining finger passing through said curved recess at a position inwardly of said hooked portion.

18. A ceiling panel as claimed in claim 17, wherein said securing arms of each torsion spring are movable towards each other from an unbiased position reducing an angle defined between said securing arms and allowing said coil of the torsion spring to be inserted on said retaining finger and captured on said retaining finger when said securing arms return to an unbiased position.

19. A ceiling panel as claimed in claim 11, wherein said securing arms of each torsion spring are movable from a neutral position inwardly towards each other against a bias force created by said torsion spring, said securing arms in said neutral position locking said torsion spring on said retaining finger by an interference relationship with said base portion.

20. A ceiling panel securing clip as claimed in claim 11, wherein said hooked portion is shaped and positioned relative to a cutaway portion in said base portion at said inside edge to define a narrow curved gap between said hooked portion and said cutaway portion, said narrow curved gap being of a size to allow a portion of a coil of a torsion spring to pass therethrough and be retained on said retaining finger.

* * * * *